United States Patent [19]

De Marco, Jr.

[11] 4,183,525

[45] Jan. 15, 1980

[54] POCKET BILLIARD TABLE

[75] Inventor: John De Marco, Jr., Prescott, Ariz.

[73] Assignee: Twelve Pocket Billiard-Pool, Inc., Las Vegas, Nev.

[21] Appl. No.: 777,831

[22] Filed: Mar. 15, 1977

[51] Int. Cl.[2] ..... A63D 15/00

[52] U.S. Cl. ..... 273/12

[58] Field of Search ..... 273/2, 12, 3 R, 3 A, 273/3 B, 4 C, 4 A, 4 B, 4 R, 119 R, 119 A, 119 B, 123 R, 123 A, 124 R, 124 A, 118 R, 118 A, 118 D, 110, 121 R, 121 A, 121 D, 122 R, 122 A, 122 D, 122 E, 125 R, 125 A, 126 R, 126 A, 5 A, 5 B, 5 C, 6, 7, 8, 9, 10, 11 R, 11 C, 12, 13, 14, 113, 115

[56] References Cited

U.S. PATENT DOCUMENTS

| | | | |
|---|---|---|---|
| D. 83,747 | 3/1931 | Pavelka et al. | 273/3 A |
| 204,134 | 9/1878 | Richardson | 273/3 A |
| 575,097 | 1/1897 | Beman | 273/123 R |
| 615,469 | 12/1898 | Barrows | 273/115 |
| 736,938 | 8/1903 | Clark | 273/123 R |
| 846,110 | 3/1907 | Jurick | 173/126 R |
| 1,176,367 | 3/1916 | Jackson | 273/119 R |
| 1,231,608 | 7/1917 | Holdredge | 273/115 |
| 1,276,676 | 8/1918 | Mischanski | 273/119 R |
| 1,320,274 | 10/1919 | Ramsey | 273/123 R |
| 3,653,665 | 4/1972 | Wahlberg | 273/126 R |
| 4,017,079 | 4/1977 | Apellaniz | 273/126 R |

FOREIGN PATENT DOCUMENTS

| | | | |
|---|---|---|---|
| 7342 | of 1903 | United Kingdom | 273/119 R |

*Primary Examiner*—Richard C. Pinkham
*Assistant Examiner*—T. Brown
*Attorney, Agent, or Firm*—Seiler & Quirk

[57] ABSTRACT

An improved rectangular pocket billiard table having a flat and horizontal playing surface and a cushioned rail extending therearound, and which surface has a pair of long and a pair of short opposite parallel sides and four right angle corners at the intersection of the sides comprises a plurality of spaced pockets along each pair of long sides and having no pockets in any of the corners nor along the short sides. In the preferred embodiment, the number of pockets along each long side is six and which pockets are clustered in groups of three pockets each.

5 Claims, 2 Drawing Figures

POCKET BILLIARD TABLE

BACKGROUND OF THE INVENTION

Common standard pocket billard or pool tables comprise a rectangular substantially flat and horizontal playing surface defined between two long and opposite side rails and a pair of shorter opposing parallel end rails. There are six pockets, four being located in the corners where the rails intersect and two pockets located along the long side rails and evenly spaced between the ends or corners. Although such table and games played thereon commonly with fifteen consecutively numbered balls and a cue ball are interesting, because of the relatively few number of pockets, and especially because of the corner pockets, the number of games which require a high degree of skill or which are quite difficult for accomplished players are few.

SUMMARY OF THE INVENTION

The present invention is directed to a novel pocket billiard table in which there are no corner pockets and having instead, pockets located only along the long side rails. Preferably, there are between four and six pockets on each side, and more preferably, six such pockets. In a further preferred embodiment, the pockets are clustered in groups of three, and pockets on opposite side rails are opposing. Moreover, these pockets are preferably numbered so that games can be played wherein a numbered ball must drop into the pocket bearing the same number as the ball. The advantage of such a table is the significant variety of games that can be played, many of which are quite difficult and offer exceptional challenges to the skilled or accomplished player.

DETAILED DESCRIPTION OF THE INVENTION

Figure 1:
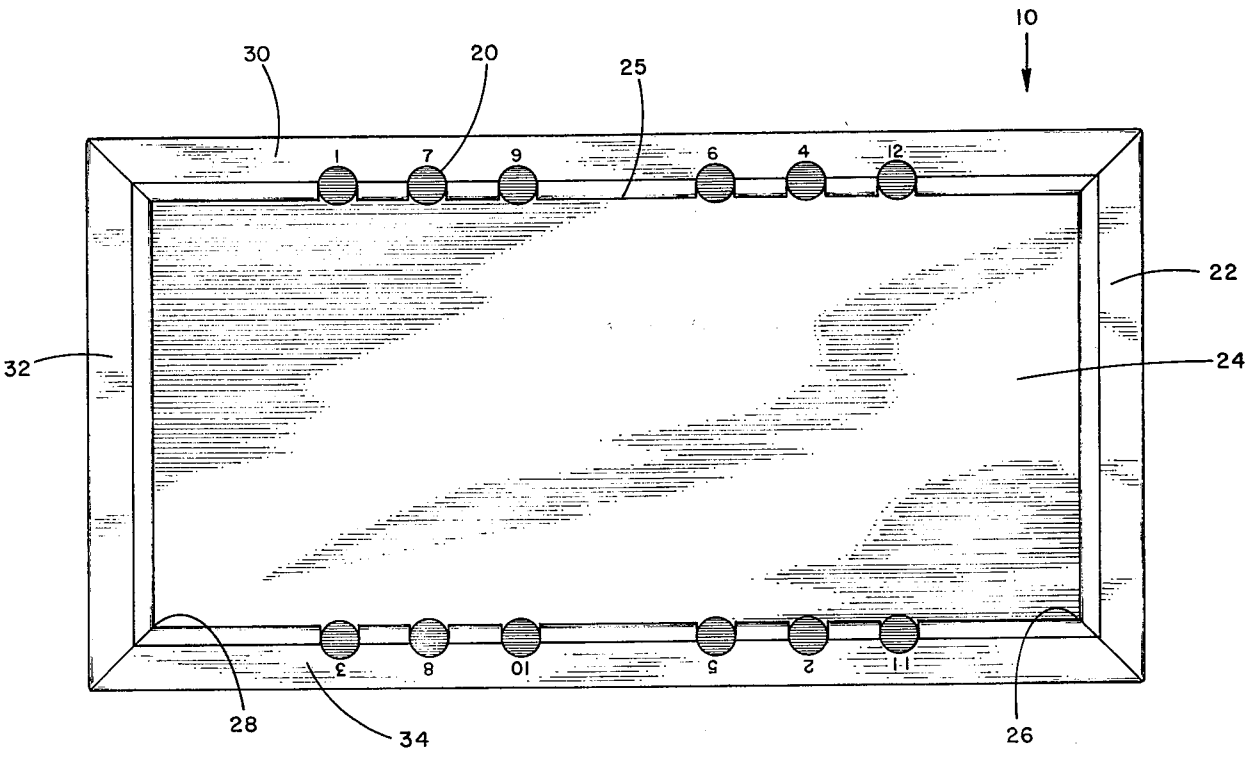
FIG. 1 is a top plan view of the preferred pocket billiard table of the invention.

As shown in the drawings, the billiard table generally 10 comprises a flat and substantially horizontal and smooth playing surface 24. Commonly, the surface is covered with felt or other suitable material. The base surface of the table covered by the felt may be any suitable composition, normally slate, although other natural or synthetic composition may be used as desired.

Figure 2:
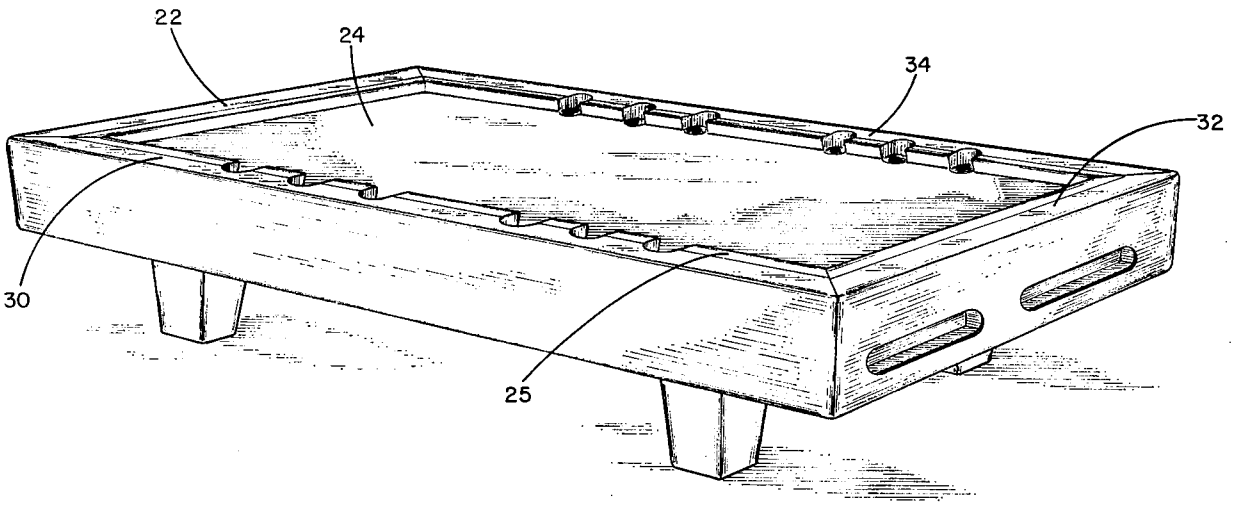
FIG. 2 is a perspective view of a pool table incorporating the improved pocket design of the invention.

The playing surface 24 is defined between side rails 30 and 34 and end rails 32 and 22. These rails are preferably like those used in state of the art tables and include a felt covered wedge shaped cushion 25 which projects somewhat into the playing surface and against which cushion edges the balls are deflected during play on the table. Again, such table construction, as is generally shown in FIG. 2, is well known by those skilled in the art for pool or pocket billiard tables and need not be described further herein. The table playing surface is rectangular with the side rails being normally twice the length of the end rails. Any playing surface size may be used such as $3\frac{1}{2}\times7$ feet, $4\times8$ feet, or $4\frac{1}{2}\times9$ feet, the latter two sizes being the most popular. The table may also incorporate vending or coin operated means.

The improvement of the specific table of the present invention comprises a plurality of pockets 20 located along each elongated side rail, and having no pockets in the corners or along the end rails. In the preferred embodiment shown, there are six pockets along each side, and clustered in groups of three. In such an arrangement, it is also preferred that the distance between the groups, i.e., between nearest pockets of the different groups, is greater than the distance between adjacent pockets within a group. Moreover, in the preferred embodiment shown, the groups of pockets are located somewhat closer to the center of the side rails than to the corners. In other words, the groups of pockets along side rail 34 are closer to the center of the side rail than they are to the two corners 26 and 28. In addition, the pockets along a side rail are substantially exactly opposite from the pockets on the opposing side rail as shown.

For certain games played on the table of the invention, it is preferred that the pockets are numbered, with the numerals being clearly visible for each pocket. Pocket numbers are shown in FIG. 1 numbering one through 12 although the specific designation of any pocket number is not so critical and may be varied as desired. For example, all odd or all even numbers can be used on any one side, in sequence or mixed. However, the pocket designations shown are preferred. Utilizing such pocket number designations, the kinds and variety of games are numerous. Especially interesting and often difficult are games in which any given number ball must be dropped in a pocket bearing that same number. Thus, in a twelve pocket pool table, after the break, the only points that can be scored or which count are the ones where a ball goes into the pocket having the matching number with the exception of the balls marked 13, 14 and 15. An example of play for those balls, is that they may be counted only when they are dropped in rotation after the first twelve balls have been properly made, and they are made in numerical succession with the pocket being called. A great number of games may be played in which any single ball must be dropped in the pocket bearing its number whereas other selected balls may be dropped in any pocket, again, so long as the pocket is called. If the designated ball goes into any other pocket, that shooter loses. Other games include those in which a player may utilize pockets only on one side of the table, or make balls only on those groups of pockets on one end of the table center line. In still other games, two different cue balls may be used, one distinguished by marking from the other.

Although the preferred table shown is one having six pockets along each side, shown in groups of three, instead, four or five pockets may be used along each side. For esthetic reasons, if five pockets are used, they will preferably be evenly spaced apart and evenly spaced between the corners. If four pockets are used along each side, they may be clustered in groups of two, like the groups of three shown, or evenly spaced, as desired. The advantages of utilizing such a table as disclosed in the invention as well as the great variety and difficulty of games which may be played thereon will be evident to those skilled in the art.

I claim:

1. A pocket billiard table comprising a fully open, rectangular, flat and horizontal playing surface bordered by a cushioned edge extending therearound, said edge having a long pair and a short pair of opposite and parallel straight sides and four right angle corners at the intersection of said sides, and a plurality of at least four fully exposed pocket openings in said cushioned edge and spaced along each of said long pair and having no pockets in any of said corners nor along said short pair of sides.

2. The billiard table of claim 1 wherein the number of pockets along each side of said long pair is between four and six.

3. The billiard table of claim 2 wherein the pockets spaced along one side are opposite the pockets spaced along the opposite side.

4. The billiard table of claim 3 wherein the number of pockets on each said side comprises six and wherein said pockets are clustered in groups of three each, and wherein the distance between individual pockets with each group is closer than the distance between adjacent pockets of different groups.

5. The billiard table of claim 4 including a different number secured adjacent each pocket.

* * * * *